US012310459B2

(12) United States Patent
Siegismund et al.

(10) Patent No.: US 12,310,459 B2
(45) Date of Patent: May 27, 2025

(54) ARTICLE OF FOOTWEAR HAVING A CLOSURE SYSTEM

(71) Applicant: PUMA SE, Herzogenaurach (DE)

(72) Inventors: Andreas Siegismund, Rueckersdorf (DE); Reinhold Sussmann, Scheinfeld (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 17 days.

(21) Appl. No.: 18/085,108

(22) Filed: Dec. 20, 2022

(65) Prior Publication Data

US 2023/0189936 A1 Jun. 22, 2023

Related U.S. Application Data

(60) Provisional application No. 63/292,289, filed on Dec. 21, 2021.

(51) Int. Cl.
*A43C 11/20* (2006.01)
*A43B 11/00* (2006.01)

(52) U.S. Cl.
CPC ..... *A43C 11/20* (2013.01); *A43B 11/00* (2013.01)

(58) Field of Classification Search
CPC ..... A43C 11/008; A43C 11/14; A43C 11/16; A43C 11/165; A43C 11/20; A43C 11/22
See application file for complete search history.

(56) References Cited

U.S. PATENT DOCUMENTS

| | | | | |
|---|---|---|---|---|
| 5,737,854 | A * | 4/1998 | Sussmann | A43C 11/16 36/107 |
| 10,004,297 | B2 * | 6/2018 | Lovett | A43C 1/00 |
| 10,368,608 | B2 * | 8/2019 | Dyer | A43B 23/0245 |
| 11,497,278 | B2 * | 11/2022 | Aoki | A43C 11/1493 |
| 11,844,401 | B2 * | 12/2023 | Swigart | A43C 11/165 |
| 2018/0310671 | A1 * | 11/2018 | Soderberg | A43C 11/165 |
| 2021/0093046 | A1 * | 4/2021 | Lam | A43C 1/06 |
| 2021/0235819 | A1 * | 8/2021 | Andreasen | A43B 23/26 |
| 2021/0259365 | A1 * | 8/2021 | Maselino | A43C 11/008 |
| 2022/0007793 | A1 * | 1/2022 | Bidal | A43C 1/003 |
| 2022/0110401 | A1 * | 4/2022 | Crumbleholme | A43C 11/16 |

* cited by examiner

*Primary Examiner* — F Griffin Hall
(74) *Attorney, Agent, or Firm* — Quarles & Brady LLP

(57) ABSTRACT

A closure system for an article of footwear includes an actuation mechanism, a release mechanism, a closure mechanism, and a cord. The cord is configured to be operably engaged with an upper of the footwear. The actuation mechanism is configured to be pulled to actuate the closure system to adjust the footwear from a loosened configuration to a tightened configuration. In addition, the release mechanism is configured to adjust the footwear from the tightened configuration to the loosened configuration.

22 Claims, 11 Drawing Sheets

ARTICLE OF FOOTWEAR HAVING A CLOSURE SYSTEM

CROSS-REFERENCE TO RELATED APPLICATIONS

This application claims the benefit of and priority to U.S. Provisional Application No. 63/292,289, filed on Dec. 21, 2021, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a fastening system or closure system.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms.

SUMMARY

An article of footwear, as described herein, may have various configurations. The article of footwear may have an upper and a sole structure connected to the upper.

In some aspects, a closure system for an article of footwear includes an actuation mechanism, a release mechanism, a closure mechanism, and a cord. The cord is configured to be operably engaged with an upper of the footwear. The actuation mechanism is configured to be pulled to actuate the closure system to adjust the footwear from a loosened configuration to a tightened configuration. In addition, the release mechanism is configured to adjust the footwear from the tightened configuration to the loosened configuration.

In some embodiments, the actuation mechanism is a strap and the release mechanism is a dial. In some embodiments, the closure mechanism is a disc. Further, the closure mechanism is configured to hold the footwear in the tightened configuration. The cord is comprised of multiple segments operably coupled to one another by the closure mechanism. In some embodiments, the tightened configuration includes varying levels of tightness, which include a first level, a second level, and a third level. Additionally, the third level is tighter than the second level and the second level is tighter than the first level.

In another aspect, a closure system is provided for an article of footwear having a sole connected to an upper. The closure system includes an actuation mechanism, a release mechanism, and a closure mechanism. Further, the closure system is decentralized and is operably connected by a cord that extends along the footwear.

In some embodiments, the actuation mechanism is arranged in a heel region of the footwear and the release mechanism is arranged in a midfoot region of the footwear. In some embodiments, the closure mechanism is positioned on the upper within a midfoot region of the footwear. In other embodiments, the closure mechanism is disposed within the sole of the footwear. In some embodiments, the closure mechanism and the release mechanism are arranged in a midfoot region of the footwear. Further, the cord includes a first segment and a second segment. The first segment extends between the actuation mechanism and the closure mechanism and the second segment extends from the closure mechanism to a retention member. Additionally, the first segment of the cord is formed of an elastic material that is configured to retract the actuation mechanism from an actuation configuration to a rest configuration.

In still another aspect, a centralized closure system is provided for an article of footwear. The centralized closure system includes an actuation mechanism, a release mechanism, and a closure mechanism. The centralized closure system is configured to provide haptic feedback to a user. Further, the actuation mechanism is configured be pulled to actuate the closure system, and the actuation mechanism is configured to be retracted after actuation of the closure system.

In some embodiments, the closure mechanism is operably engaged with a cord to tighten the footwear. Further, the actuation mechanism is configured to be pulled away from the closure mechanism to actuate the closure system. The actuation mechanism is operably engaged with a coil spring disposed within the closure mechanism, with the coil spring being configured to retract the actuation mechanism toward the closure mechanism. In some embodiments, the actuation mechanism and the closure mechanism are operably coupled to one another and disposed within a midfoot region of the footwear.

In some aspects, an article of footwear includes an upper that is attached to a sole, a longitudinal axis that extends between a rear end and a front end of the article of footwear, and a midfoot region that is disposed between a forefoot region and a heel region. The article of footwear further comprises a heel component disposed adjacent the rear end within the heel region. The heel component has a midsection that includes padding or foam. Further, the article of footwear includes a fastening system having a release mechanism that is operably engaged with a cord. The release mechanism includes a disc-shaped housing that is mounted to a top section of the upper within a midfoot region. The cord is laced through a plurality of conduits arranged on the upper. A distance is defined between the midsection of the heel component and the upper. The distance is configured to be adjusted between a first configuration and a second configuration. The midsection of the heel component is configured to be translated rearward and upward relative to the longitudinal axis, and the midsection of the heel component is configured to be translated forward and downward relative to the longitudinal axis.

In some embodiments, the midsection of the heel component is configured to be gripped by a user. In some embodiments, the midsection extends between a first end and a second end of the heel component. The first end is arranged adjacent the medial side and the second end is arranged adjacent the lateral side. In some embodiments, the midsection of the heel component is concavely curved between the medial side and the lateral side relative to a toe end of the article of footwear. In sonic embodiments, the midsection of the heel component is configured to at least partially deform when translated between the first configuration and the second configuration. In some embodiments, at least a portion of the cord is arranged on the upper between a medial side and a lateral side of the article of footwear to form a V-shaped pattern. In some embodiments, the release mechanism is disposed centrally between the lateral side and the medial side of the article of footwear.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
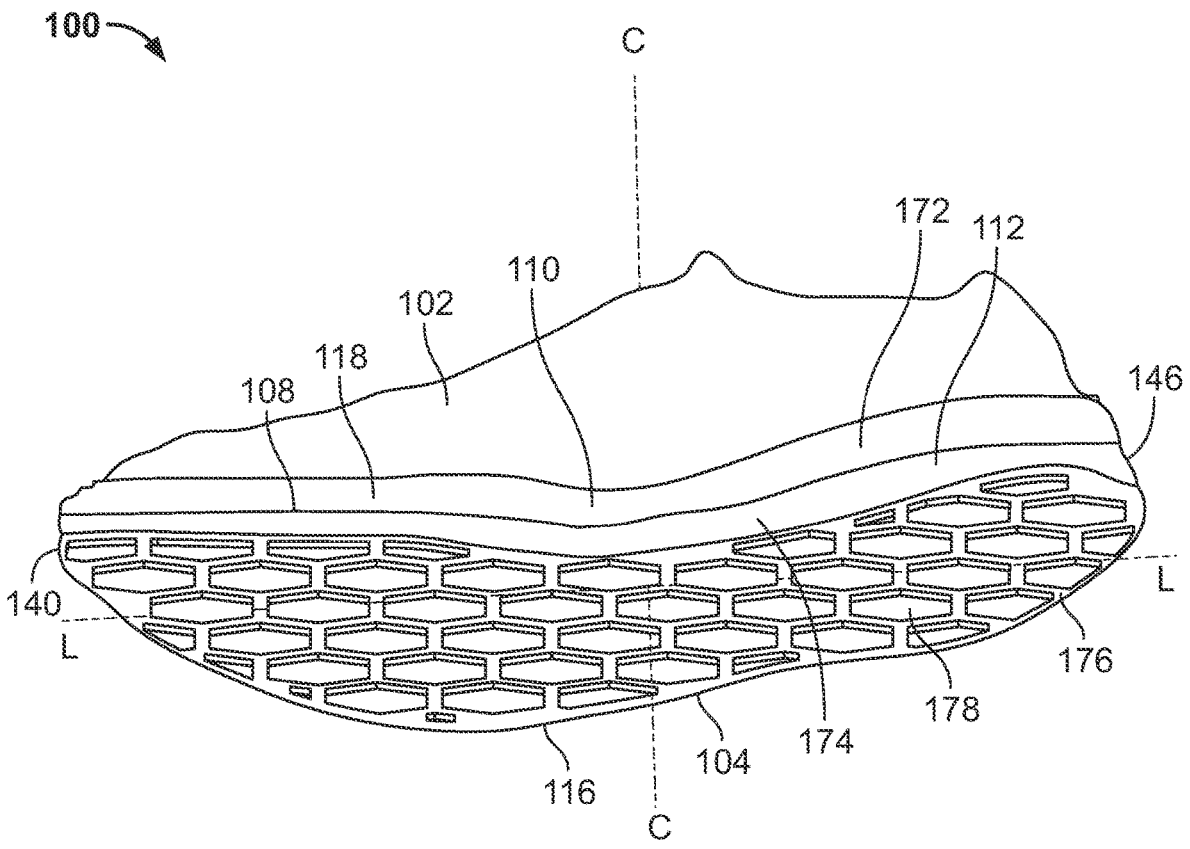
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, well knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
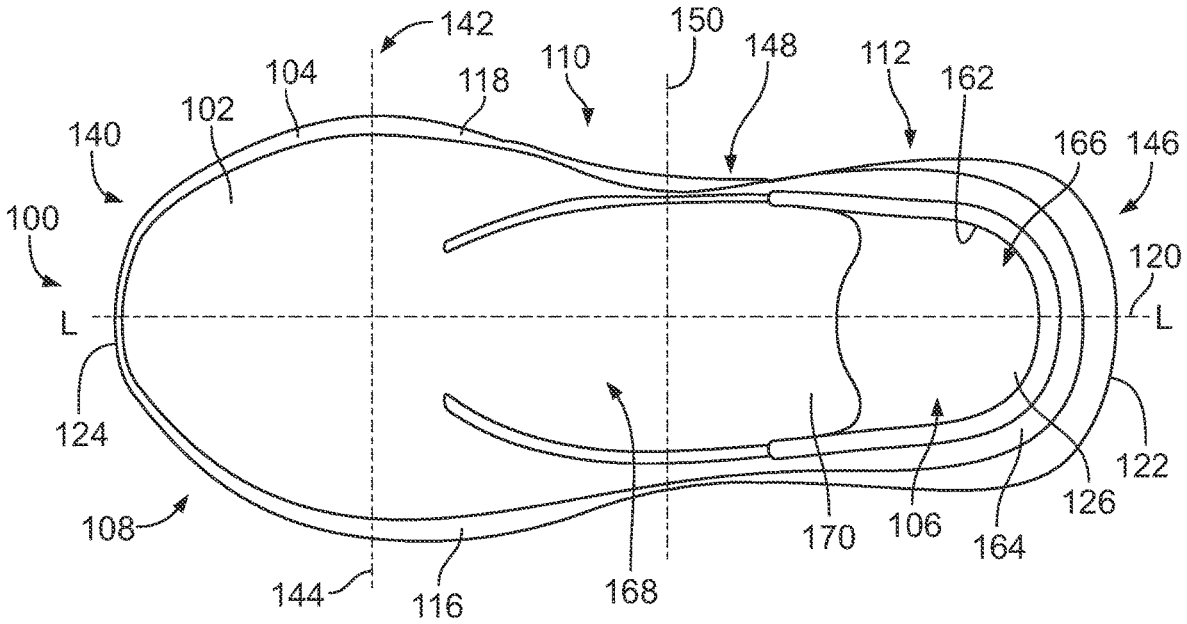
FIG. 2 is a top view of the article of footwear of FIG. 1.
Figure 3:
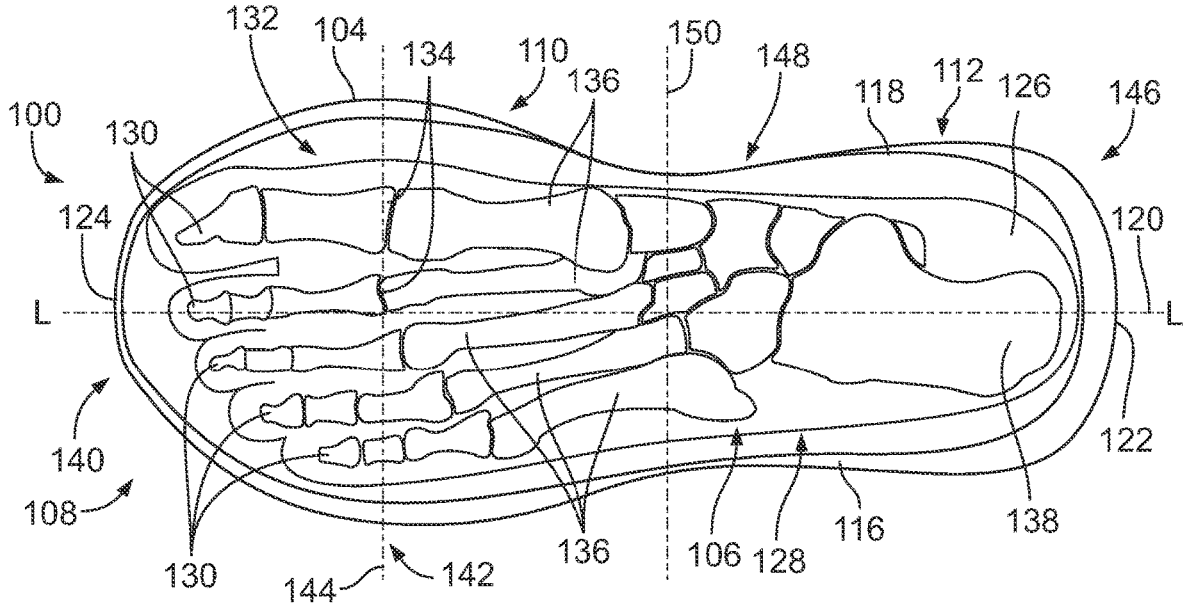
FIG. 3 is a top plan view of the article of footwear of FIG. 1, with an upper removed and a user's skeletal foot structure overlaid thereon.

FIGS. 1-3 depict an exemplary embodiment of an article of footwear 100 including an upper 102 and a sole structure 104. The upper 102 is attached to the sole structure 104 and together define an interior cavity 106 (see FIGS. 2 and 3) into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging, surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be foamed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Figure 4:
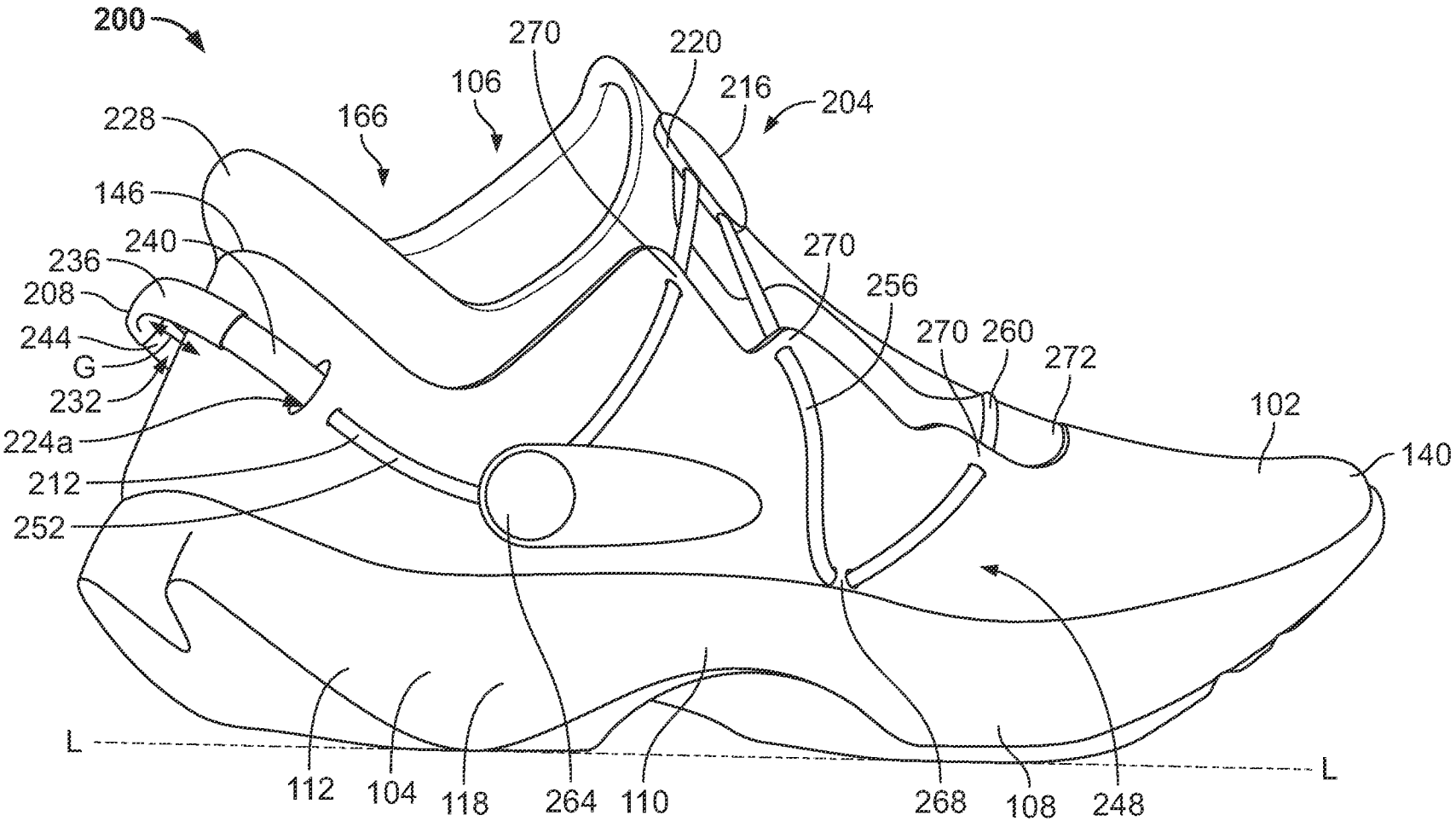
FIG. 4 is a schematic representation of a perspective view of a medial side and a heel end of an article of footwear configured as a left shoe, according to an embodiment of the disclosure.

FIG. 4 depicts a schematic representation of an article of footwear 200 having a fastening system or closure system 204 that includes an actuation mechanism in the form of a strap or heel component 208 that is operably engaged with a cord 212 to actuate the closure system 204 to tighten the article of footwear 200 around a user's foot, e.g., adjusting the footwear 200 from a loosened configuration to a tightened configuration. Further, the closure system 204 includes a release mechanism 216 in the form of a switch or dial that is operably engaged with the cord 212 for unlocking and/or releasing the footwear 200 after being tightened, e.g., from the tightened configuration to the loosened configuration. In addition, the closure system 204 includes a closure mechanism or a disc 220 that is operably engaged with the cord 212 to selectively lock or hold the footwear 200 in a tightened configuration and to selectively be unlocked or released by operation of the release mechanism 216.

Referring to FIG. 4, the strap 208 is arranged on the upper 102 and within the heel region 112 of the footwear 200. In particular, the strap 208 is located at the heel end 146 of the footwear 200 and extends in a generally U-shaped path between a pair of apertures 224*a*, 224*b*, only one of which is visible from the view of FIG. 4. The apertures 224*a*, 224*b* are disposed on the medial side 118 and the lateral side 116, respectively, of the upper 102 within the heel region 112. In the illustrated embodiment, the strap 208 is spaced apart from the sole 104 and below a collar 228 that surrounds the opening 166 to the interior cavity 106 of the upper 102. Further, the apertures 224*a*, 224*b* are arranged an equal distance from the sole 104 and also spaced apart from one another. The apertures 224*a*, 224*b* are connected to channels (not shown) formed within the upper 102 and extending in the heel region 112 toward the midfoot region 110.

In FIG. 4, the strap 208 is depicted in a rest configuration in which a gap 232 is formed between the upper 102 and the strap 208. In particular, in the rest configuration the midsection 236 of the strap 208 is located a distance G from the upper 102, such that the strap 208 extends from the heel end 146 of the upper 102 in a rearward direction and an upward direction relative to the longitudinal axis L. The midsection 236 of the strap 208 is relatively thicker than the surrounding portions of the strap 208. To that end, the midsection 236 may include padding, e.g., foam, to provide comfort, durability, and resilience when gripped by a user. Further, the midsection 236 extends between a first end 240 and a second end 244 of the strap 208, such that the strap 208 and the midsection 236 thereof curves concavely between the lateral side 116 and and the medial side 118 relative to the toe end 140. In the rest configuration, the first and second ends 240, 244 of the strap 208 are disposed within or adjacent the apertures 224*a*, 224*b* and the channels (not shown) of the upper 102. It can be appreciated from FIG. 4 that the first and second ends 240, 244 of the strap 208 are coupled to the cord 212 for operably engagement and/or actuation of the closure system 204. In the rest configuration, the first and second ends 240, 244 are coupled to portions of the cord 212 adjacent the apertures 224*a*, 224*b* and at least partially concealed within the upper 102. It is contemplated that the strap 208 is formed of a resilient material that is configured to retain its shape in the rest configuration, as illustrated in FIG. 4.

Still referring to FIG. 4, the cord 212 is arranged on the upper 102 within the heel region 112 and the midfoot region 110 of the footwear 200. In the illustrated embodiment, the cord 212 defines a winding region 248 that may extend across the upper 102 and/or the sole 104 and across several regions of the footwear 200. The cord 212 is comprised of a plurality of segments, including a first segment 252 that extends between the strap 208 and the release mechanism 216 and/or disc 220. Further, the cord 212 includes a second segment 256 extending between the release mechanism 216 and/or disc 220 and a retention member 260 arranged on the upper 102. The retention member 260 may be provided in the form of a loop or series of loops, although other configurations are possible. In the illustrated embodiment, the retention member 260 is located within the forefoot region 108 of the upper 102 and spaced apart from the release mechanism 216 and/or disc 220, although other configurations are possible. The second segment 256 of the cord 212 may be coupled to the sole 104 at a point between the retention member 260 and the release mechanism 216 and/or disc 220. In some embodiments, a plurality of retention members 260 are arranged on the upper 102 and/or the sole 104 for retaining the cord 212.

The cord 212, including the first segment 252 and the second segment 256, is configured to translate tensional forces applied by the strap 208 and/or the disc 220 into compression, e.g., tightening, forces and to distribute such compression forces about the footwear 200 to tighten around a user's foot. In the illustrated embodiment, the first segment 252 and the second segment 256 of the cord 212 extend along both the lateral side 116 and the medial side 118 of the upper 102, although other configurations are possible. In particular, the first segment 252 of the cord 212 of the closure system 204 is disposed in a V-shape pattern between apertures 224*a*, 224*b* and the disc 220 and/or release mechanism 216, where a first lowermost point 264 is positioned on the upper 102 adjacent the sole 104 within the heel region 112. It is contemplated that the first lowermost point 264 may be disposed on or within the sole 104 and within a different region of the footwear 200. The second segment 256 of the cord 212 may also be disposed in a V-shape pattern between the disc 220 and/or release mechanism 216 and the retention member 260, where a second lowermost point 268 is positioned on the upper 102 adjacent the sole 104 within the midfoot region 110. It is contemplated that the second lowermost point 268 of the second segment 256 may be disposed on or within the sole 104 and within a different region of the footwear 200. Further, it is contemplated that the first lowermost point 264 of the first segment 252 and the second lowermost point 268 of the second segment 256 can be positioned at different elevations relative to the sole 104 and/or to the longitudinal axis L.

It is contemplated that the cord 212 includes multiple, distinct sections joined or coupled together, such as the first segment 252 being jointed to the second segment 256 by the release mechanism 216 and/or the disc 220. In some embodiments, the cord 212 is comprised of multiple sections that are integrally formed as a unitary member. Further, the cord 212 may be formed of a variety of resilient and flexible materials, such as, e.g., elastic or thermoplastic materials, woven or non-woven fabric or fibrous materials, or some combination thereof. In some embodiments, the cord 212 is fastened to the upper 102 and/or the sole 104 by a plurality of the retention members 260 arranged in several regions of the footwear 200. Additionally or alternatively, the cord 212 may be laced or threaded through a plurality of conduits 270 formed within the upper 102 and/or the sole 104, such as, e.g., a passage formed between layers or substrates comprising the upper 102 and/or the sole 104. In some embodiments, the conduits 270 may extend continuously along the upper 102 and/or the sole 104 such that the entire cord 212 is enclosed therein. In some embodiments, the conduit 270 is provided in distinct sections such that portions or segments of the cord 212 are exposed outside of the upper 102 or inside the interior cavity 106.

Further, the cord 212 may be attached to the insole 126 along a periphery or portions thereof. It is contemplated that the cord 212 can be woven and/or weaved into the upper 102, or layers or substrates thereof, such that the upper 102 is formed integrally with the cord 212 embedded therein. In this way, manufacturing of the upper 102 and the cord 212 can be accomplished efficiently in fewer steps and with less labor. Further, it is contemplated that the cord 212 is fashioned from multiple materials having different material properties for achieving different functions. For example, segments of the cord 212 may be configured to be more flexible than other segments to control the tensional forces distributed there along in particular regions or areas of the footwear 200. Further, the cord 212 is configured, via material properties and attachment or integration with the upper 102, to withstand repeated tension and flexure throughout repeated use, as well as to withstand outdoor environments.

Referring to FIG. 4, the release mechanism 216 is arranged on a top section 272 of the upper 102 within the midfoot region 110 of the footwear 200. In the illustrated embodiment, the release mechanism 216 is provided as a generally rounded component located centrally, between the lateral side 116 and the medial side 118 of the footwear 200 and on the tongue 170 of the upper 102 adjacent the opening 166, although other configurations are possible. The upper 102 of the footwear 200 includes the top section 272 extending from the forefoot region 108 to the heel region 112 and around the opening 166 into the interior cavity 106. In the illustrated embodiments, the top section 272 is thickened relative to the remainder of the upper 102. It is contemplated that the top section 272 can include or surround the tongue 170. The release mechanism 216 is exposed on the upper 102 and is configured to be coupled to the cord 212 between the first segment 252 and the second segment 256. In this way, the release mechanism 216 is configured to be actuated by a user to operate the closure system 204. In some embodiments, the release mechanism 216 is configured to be twisted or rotated by a user. In other embodiments, the release mechanism 216 is configured to be pushed or pressed into the upper 102 by a user. In some embodiments, the release mechanism 216 can be twisted and pressed, such that a user can actuate the release mechanism 216 in either manner. Upon actuation, the release mechanism 216 operates a release function of the closure system 204 to allow the footwear 200 to become loosened.

As illustrated in FIG. 4, the disc 220 is arranged on the upper 102 within the midfoot region 110 of the footwear 200. In the illustrated embodiment, the disc 220 is provided as a generally rounded component located centrally between the lateral side 116 and the medial side 118 of the footwear 200 and on the tongue 170 of the upper 102 adjacent the opening 166, although other configurations are possible. A portion of the disc 220 is partially exposed on the upper 102 and below the release mechanism 216, such that the disc 220 is operably coupled to and concealed by the release mechanism 216. In this way, the disc 220 is configured to be actuated by a user to operate the closure system 204. Further, the disc 220 is configured to be operably coupled to the cord 212. The disc 220 is configured to be actuated by the first segment 252 of the cord 212 to tighten and/or loosen the footwear 200. In addition, the disc 220 is configured to be actuated by the release mechanism 216 to loosen the footwear 200.

Figure 5:
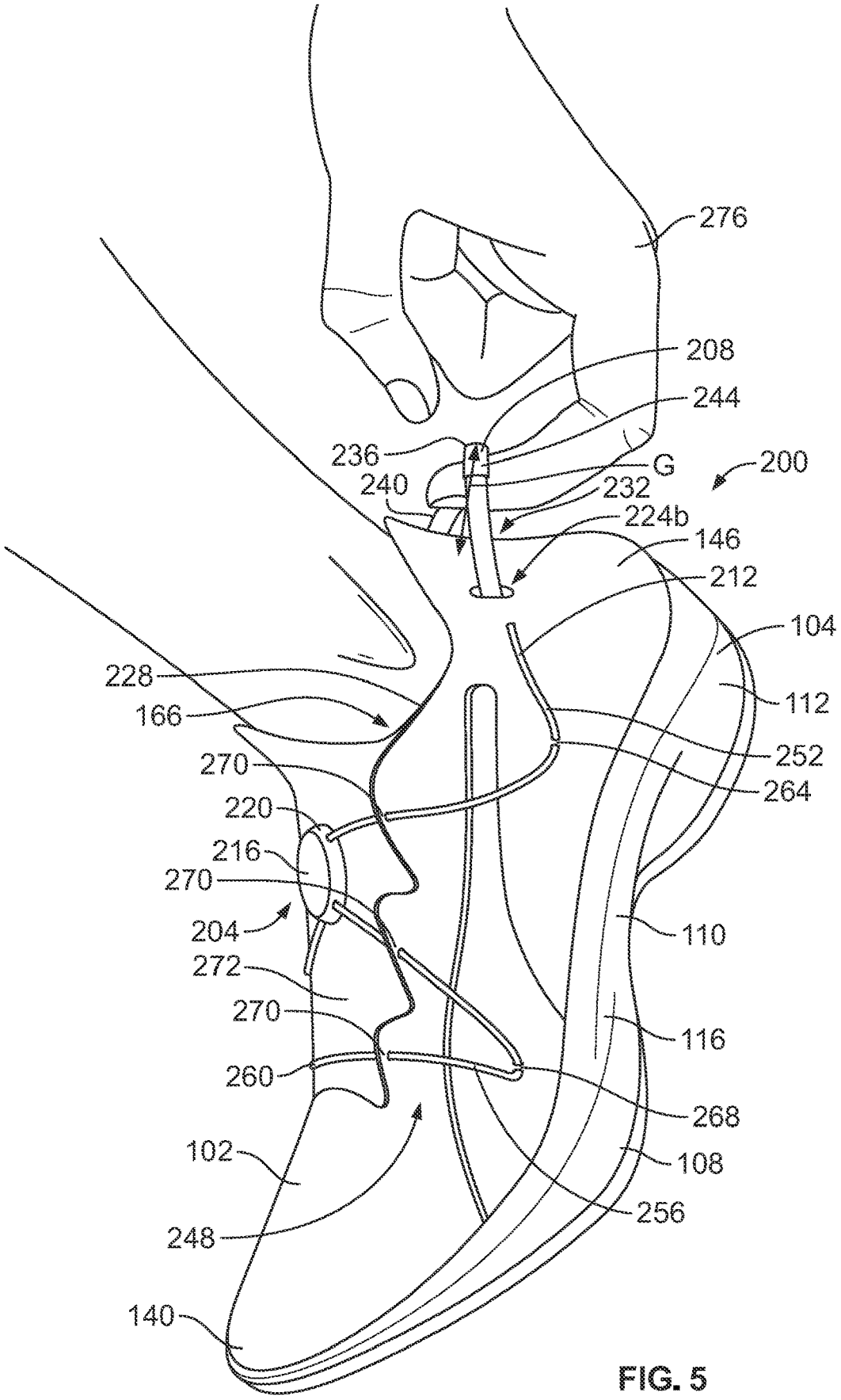
FIG. 5 is a schematic representation of a lateral side of the article of footwear of FIG. 4 in an as-worn and actuated configuration.

FIG. 5 depicts a schematic representation of the lateral side 116 of the footwear 200 with the closure system 204. In the illustrated embodiment, and similar to the medial side 118, the cord 212 of the closure system 204 includes the first segment 252 extending in a V-shape pattern between the apertures 224*a*, 224*b* and the disc 220 and/or release mechanism 216, and the second segment 256 is arranged in a V-shape pattern between the disc 220 and/or release mechanism 216 and the retention member 260. Further, the first lowermost point 264 of the first segment 252 is arranged in the heel region 112 on the lateral side 116 and the second lowermost point 268 of the second segment 256 is arranged in the forefoot region 108 on the lateral side 116.

FIG. 5 depicts the footwear 200 as-worn by a user and with the closure system 204 in an actuation configuration where the strap 208 is pulled or translated rearward and upward relative to the longitudinal axis L (see FIG. 4), away from the apertures 224*a*, 224*b* on the heel end 146 of the upper 102 by a user's hand 276. As a result, the gap 232 between the strap 208 and the upper 102 increases in size, particularly with respect to the distance G between the midsection 236 of the strap 208 and the upper 102, and the midsection 236 of the strap 208 at least partially deforms and/or changes in curvature relative to the toe end 140. In the actuation configuration depicted in FIG. 5, a portion of the first segment 252 of the cord 212 is pulled through the apertures 224*a*, 224*b* and out of the upper 102 to become at least partially exposed. To that end, when a user pulls the strap 208 from the rest configuration (see FIG. 4) to the actuation configuration (see FIG. 5), the strap 208 exerts a tensional force that is transmitted through the first segment 252 of the cord 212 to the disc 220 and/or to the second segment 256 of the cord 212. As a result of the tensional force applied to the cord 212 and transmitted to the disc 220, the closure system 204 adjusts the footwear 200 to a tightened configuration. As such, the disc 220 and/or the first segment 252 of the cord 212 applies the tensional force to the second segment 256 of the cord 212, which further distributes the compression force about the footwear 200 in several directions and several regions, allowing for comfortable and consistent tightening of the footwear 200 around a user's foot. As a result of the tensional forces applied to the first segment 252 and the second segment of the cord 212, the first lowermost point 264 of the first segment 252 may change position, such as, e.g., becoming displaced farther from the sole 104 and the second lowermost point 268 of the second segment 256 may also change position, such as, e.g., becoming displaced from the sole 104. In this way, the cord 212 is restricted and/or tightened to enclose and compress the user's foot within the interior cavity 106 of the upper 102. Further, the cord 212 may apply the tensional forces to the lateral side 116 and medial side 118 of the sole 104, such that the footwear 200 further encloses and compresses a user's foot in multiple directions for improved comfort and fit.

It is contemplated that the strap 208 is configured to automatically retract from the actuation configuration to the rest configuration. To that end, a biasing mechanism (not shown) may be included to return the strap 208 from the actuation configuration to the rest configuration, thereby decreasing the distance G between the midsection 236 of the strap 208 and the upper 102, such that the strap 208 translates forward and downward relative to the longitudinal axis L (see FIG. 4). It is contemplated that the first segment 252 of the cord 212 may be formed of a flexible or elastic material that acts as a biasing mechanism to allow for deformation, i.e., stretching, when the tensional force is applied, and then to return to an undeformed state when the tensional force is released, such that the strap 208 is translated from the actuation configuration to the rest configuration. In other embodiments, where the first segment 252 of the cord 212 may be inflexible or only partially flexible, the biasing mechanism (not shown) may be coupled to the first segment 252 at an end opposite the strap 208, such that the biasing mechanism translates the first segment 252 of the cord 212 and the strap 208 to the rest configuration simultaneously. It is contemplated that the biasing mechanism (not shown) may be a spring, such as a coil spring, which is located within the disc 220 and operably connected to the first segment 252 of the cord 212 although other configurations are possible.

Referring to FIGS. 4 and 5, the footwear 200 is adjusted from a loosened configuration to a tightened configuration by pulling the actuation mechanism, i.e., the strap 208 to actuate the closure system 204. Further, the footwear is adjusted from the tightened configuration to the loosened configuration by manipulating, e.g., twisting or pressing, the release mechanism, i.e., the release mechanism 216, to unlock the closure system 204. Accordingly, the closure system 204 is provided to allow a user to tighten and loosen the footwear 200 quickly and efficiently by providing one-touch actuation via the strap 208 and one-touch release via the release mechanism 216. To that end, the closure system 204 is also configured to allow for re-tightening and/or increased tightening of the footwear 200 when desired, even after the footwear 200 is already in the tightened configuration. It is contemplated that varying levels of tightness may be provided for different activities. For example, more vigorous activities, such as sporting activities where rapid directional changes occur, or activities involving a higher degree of footwear reinforcement, such as training or hiking on uneven terrain, may require higher levels of tightness to prevent displacement of the foot within and/or from the interior cavity 106 of the upper 102. As such, the closure system 204 is configured to provide varying levels of tightness when in the tightened configuration.

To that end, the tightened configuration can include a plurality of tightness levels for selection by a user. For example, an initial or first tightness level is reached upon a first actuation of the strap 208, i.e., pulling the strap 208 a single time to reach the actuation configuration and allowing the strap 208 to return to the rest configuration. Then, a second tightness level is reached after a second actuation of the strap 208, and a third tightness level is reached after a third actuation of the strap 208, and so on. It is contemplated that several tightness levels may be provided by the closure system 204 and that the strap 208 may be iteratively actuated in this manner to reach each successive, incremental tightness level. It is also contemplated that higher levels of tightness may be reached by applying greater tensional force to the strap 208, thereby pulling the strap 208 a greater distance G from the upper 102. In this way, a user can select the tightness level of the footwear 200 best suited for the desired activity.

Figure 6:
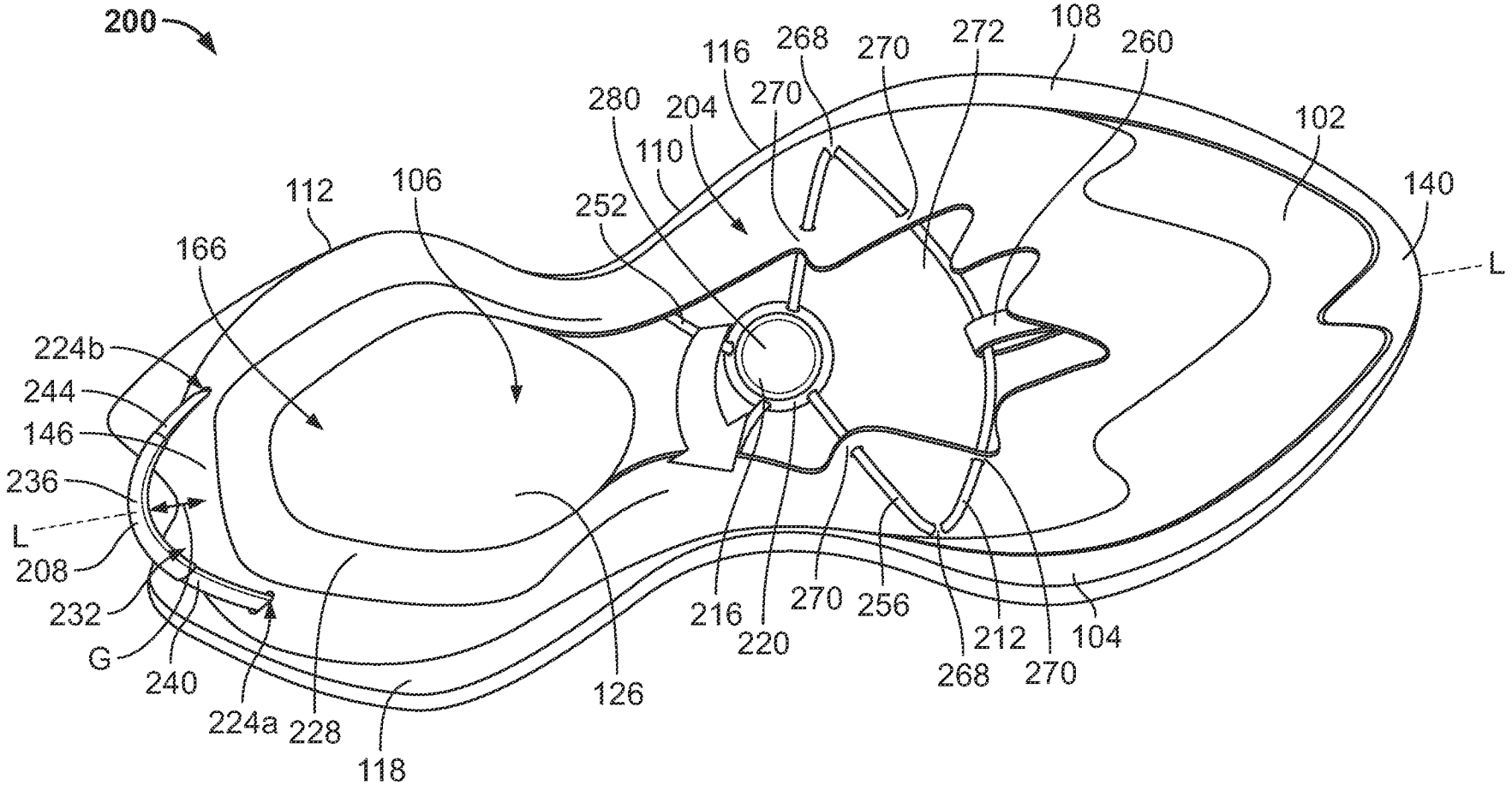
FIG. 6 is a schematic representation of a top plan view of the article of footwear of FIG. 4 in an unworn and rest configuration.

Referring to FIG. 6, which is a schematic representation of a top plan view of the article of footwear 200, the release mechanism 216 is illustrated as having a generally circular face 280 and located approximately centrally between the lateral and medial sides 116, 118, so as to be intersected by the longitudinal plane extending through the longitudinal axis L. Further, the insole 126 is illustrated within the interior cavity 106 of the upper 102, and visible through the opening 166 in the heel region 112 of the upper 102. In the illustrated embodiment of FIG. 6, the strap 208 is in the rest configuration at the heel end 146 of the footwear 200. In addition, the second segment 256 of the cord 212 is illustrated as extending across the upper 102 on the lateral and medial sides 116, 118 within the midfoot and forefoot regions 110, 108. A portion of the second segment 256 extends through the retention member 260 in the top section 272 of the upper 102.

For illustrative purposes, a yellow directional arrow is provided near the release mechanism 216 to indicate that rotation, i.e., twisting, the release mechanism 216 in the counterclockwise direction releases the closure system 204 from the tightened configuration. As a result, the cord 212 is released by the locking mechanism, e.g., the disc 220, to allow the footwear 200 to be loosened. It is contemplated that the release mechanism 216 will also automatically return to its original position by rotating clockwise, such that the user does not need to hold the release mechanism 216 in its rotated position to release the closure system 204 or loosen the footwear 200. Such automatic retraction may be enabled by the same biasing mechanism (not shown) that retracts the strap 208, or by a different biasing mechanism dedicated to the release mechanism 216 alone. Further, it is contemplated that the cord 212, upon being released, may relax from a deformed or stretched state to an undeformed and relaxed state. In doing so, the compression force distributed along the footwear 200 and, particularly, on the user's foot is at least partially released. However, due to frictional forces that exist between the cord 212 and the upper 102 and/or sole 104, such as within the channels (not shown) or by the retention member 260, a partial amount of compression forces and tensional forces are still present immediately after the release mechanism 216 releases or unlocks the closure system 204. Therefore, when in the released configuration, as depicted in FIG. 6, the user can further expand and loosen the footwear 200 via contact with a portion of the footwear 200, such as the heel region 112, to pry the foot from the interior cavity 106 of the upper 102 without resistance by the cord 212. In doing so, the cord 212 further loosens and relaxes within the upper 102 and/or the sole 104 to facilitate removal of the foot from the upper 102.

Figure 7:
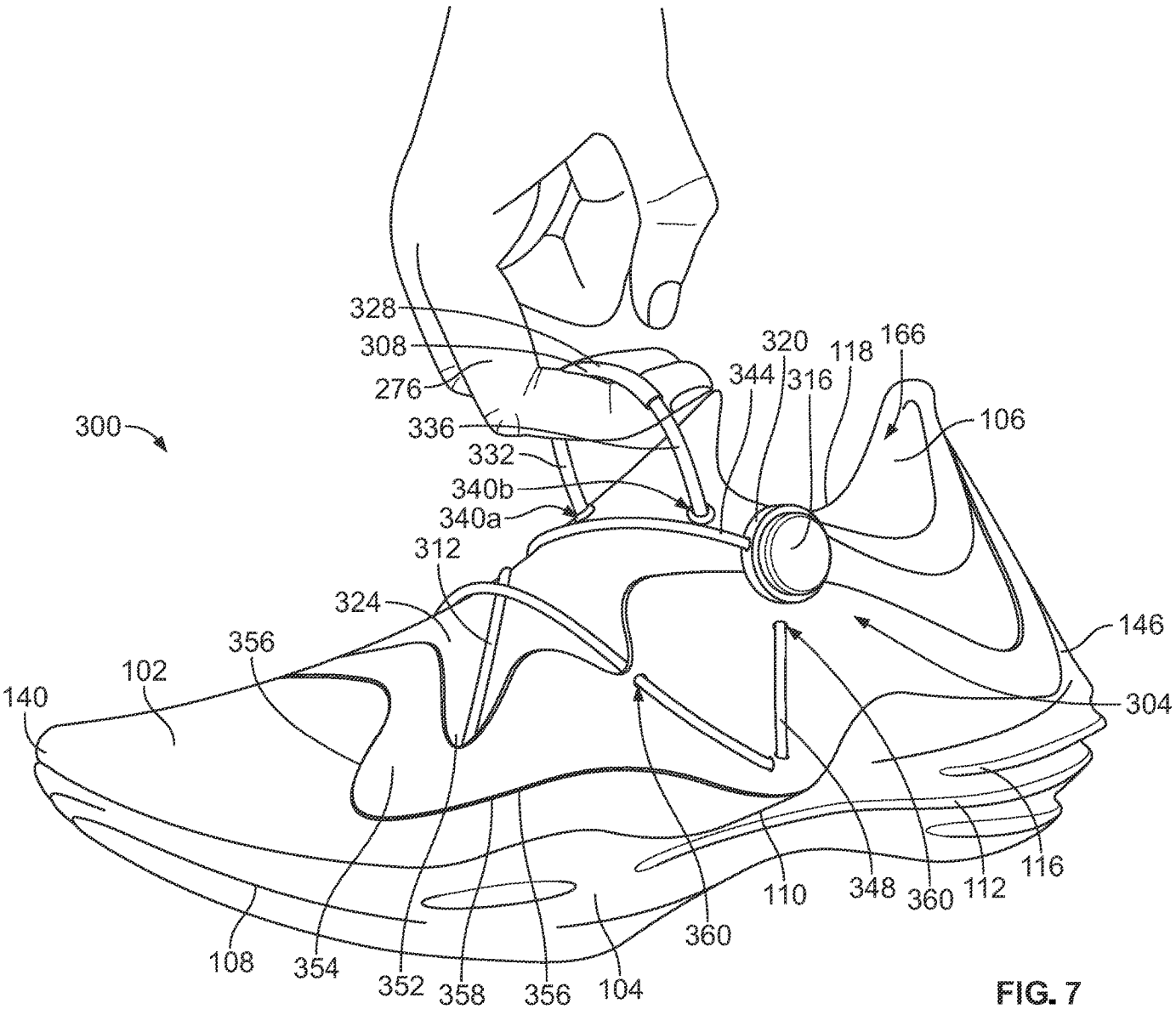
FIG. 7 is a schematic representation of a perspective lateral side and toe end view of another article of footwear configured as a left shoe, according to an embodiment of the disclosure.

FIG. 7 depicts another schematic representation of a lateral side 116 of an article of footwear 300 that is similar to the article of footwear 200. In the illustrated embodiment, the footwear 300 has a closure system 304 that is similar to the closure system 204. In particular, the closure system 304 includes an actuation mechanism in the form of a strap 308 that is operably engaged with a cord 312 to tighten and/or loosen the footwear 300. The closure system 304 further includes a release mechanism in the form of a button 316 that is also operatively coupled to the cord 312 to loosen the footwear 300. Further, the closure system 304 has a closure mechanism or disc 320 that is operably coupled to the strap 308 via the cord 312 for actuation to tighten and/or loosen the footwear 300. The disc 320 is also operably connected to the button 316 for unlocking the closure system 304 and loosening the footwear 300. In the illustrated embodiment, the strap 308 is arranged in the midfoot region 110 of the upper 102. Further, the strap 308 is located on a top section 324 of the upper 102 and disposed centrally between the lateral side 116 and the medial side 118 of the footwear 300. Accordingly, the strap 308 has a midsection 328 extending between first and second ends 332, 336 that are positioned adjacent apertures 340*a*, 340*b* formed within the top section 324 of the upper 102. It is contemplated that the apertures 340*a*, 340*b* are connected to channels (not shown) that extend into and along the upper 102 as a passage for the cord 312 and the strap 308.

As illustrated in FIG. 7, the button 316 and the disc 320 are arranged on the lateral side 116 of the upper 102 within the midfoot region 110. In the illustrated embodiment, the button 316 and disc 320 are positioned adjacent the strap 308 and on a portion of the top section 324 of the upper 102. The button 316 is configured to be pressed or pushed inwardly, i.e., toward the interior cavity 106, into the upper 102 to release the closure system 304 from a locked or tightened configuration. In addition, the disc 320 circumscribes the button 316 and, thus, the disc 320 is also arranged on the lateral side 116 of the upper 102.

As described in connection with the closure system 204, the cord 312 includes a first segment 344 that extends along the upper 102 from the disc 320 and/or button 316 to the strap 308 and toward the medial side 118 of the footwear 300. The first segment 344 of the cord 312 is operatively coupled to the strap 308 and the disc 320 and/or button 316 to actuate the closure system 304 to tighten the footwear 300. Further, the cord 312 includes a second segment 348 that extends along the upper 102 from the disc 320 and/or button 316 and down the lateral side 116 of the footwear 300. The second segment 348 of the cord 312 is operatively coupled to the button 316 and the disc 320, and the second segment 348 extends along the upper 102 within the forefoot region 108 and midfoot region 110. Both the first segment 344 and the second segment 348 of the cord 312 extend in a V-shaped pattern on respective medial and lateral sides 118, 116, such that each extend diagonally downwardly from the top section 324 toward the sole 104 before extending diagonally upwardly and back toward the top section 324 within the forefoot region 108 where the first segment 344 crosses over the second segment 348 and, finally, terminate at anchors 352, one of which is visible in FIG. 7. It is contemplated that the first segment 344 and the second segment 348 may be arranged on the footwear 300 in a different configuration, such that the second segment 348 crosses over the first segment 344 within the forefoot region 108, or in another region of the footwear 300, among other arrangements.

Accordingly, when the closure system 304 is actuated by pulling strap 308, the first and second segments 344, 348 are applied with a tensional force that is transmitted therealong to the anchors 352. As a result, the first and second segments 344, 348 are tightened between the disc 320 and the anchors 352, which causes a compression force to be distributed on the upper 102 and/or the sole 104 to tighten the footwear 300 around a user's foot. In addition, the upper 102 of the footwear 300 includes a panel 354 that is superimposed thereon along the lateral side 116 and the medial side 118 and within the forefoot region 108, the midfoot region 110, and the heel region 112. In the illustrated embodiment, the panel 354 is defined between a pair of edges 356 that interface with the upper 102 and extend in a curved manner, including various convex and concave curvatures therealong, across the footwear 300. It is contemplated that one or both of the edges 356 may also include a third segment 358 of the cord 312 that extends therealong, such that the third segment 358 is operatively coupled to the disc 320 to further distribute the compression force along the upper 102 and/or the sole 104. Further, the panel 354 includes holes or eyelets 360 through which the cord 312 is threaded or laced.

Figure 8:
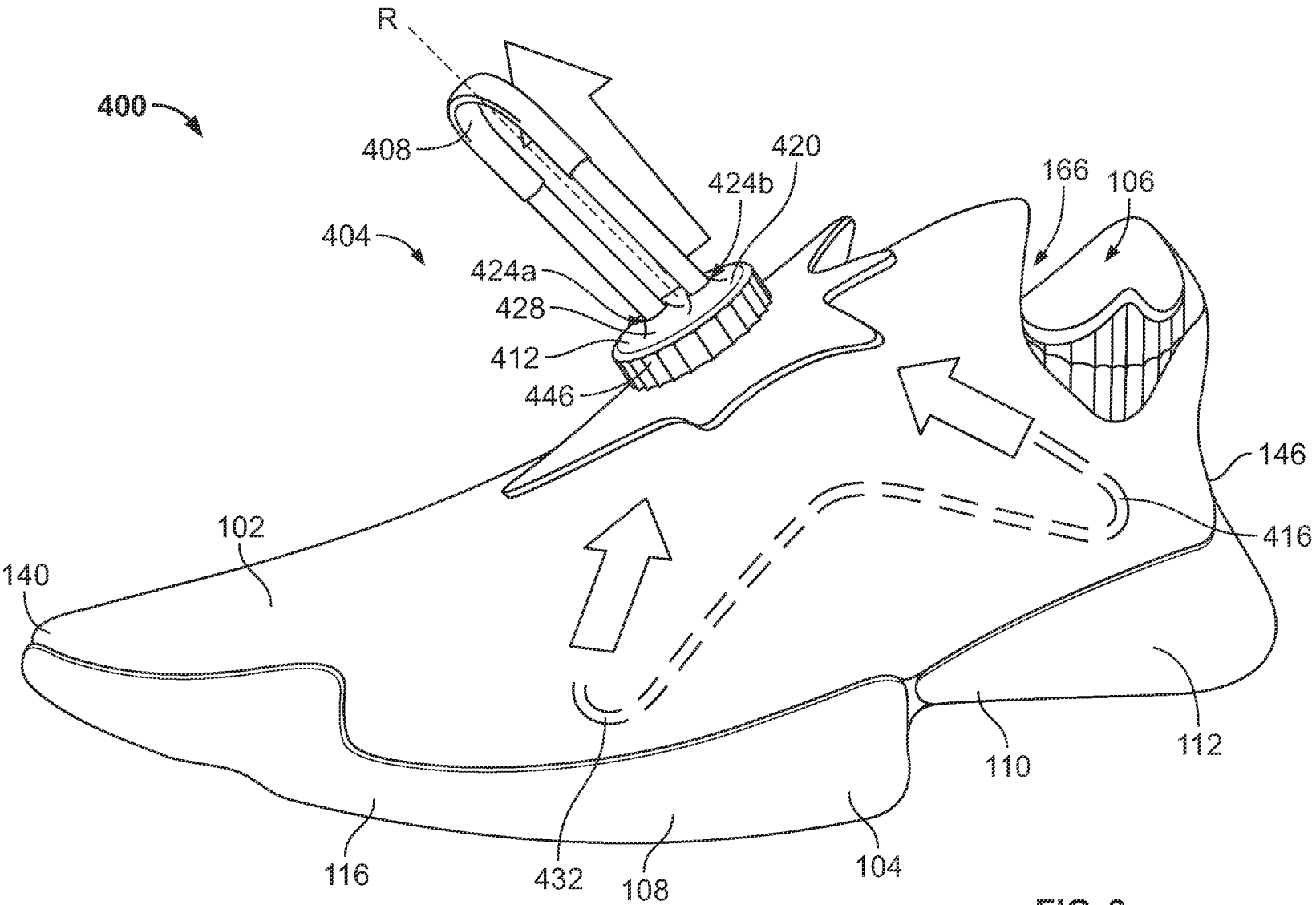
FIG. 8 is a schematic representation of a perspective lateral side and toe end view of yet another article of footwear configured as a left shoe, according to an embodiment of the disclosure.
Figure 9:
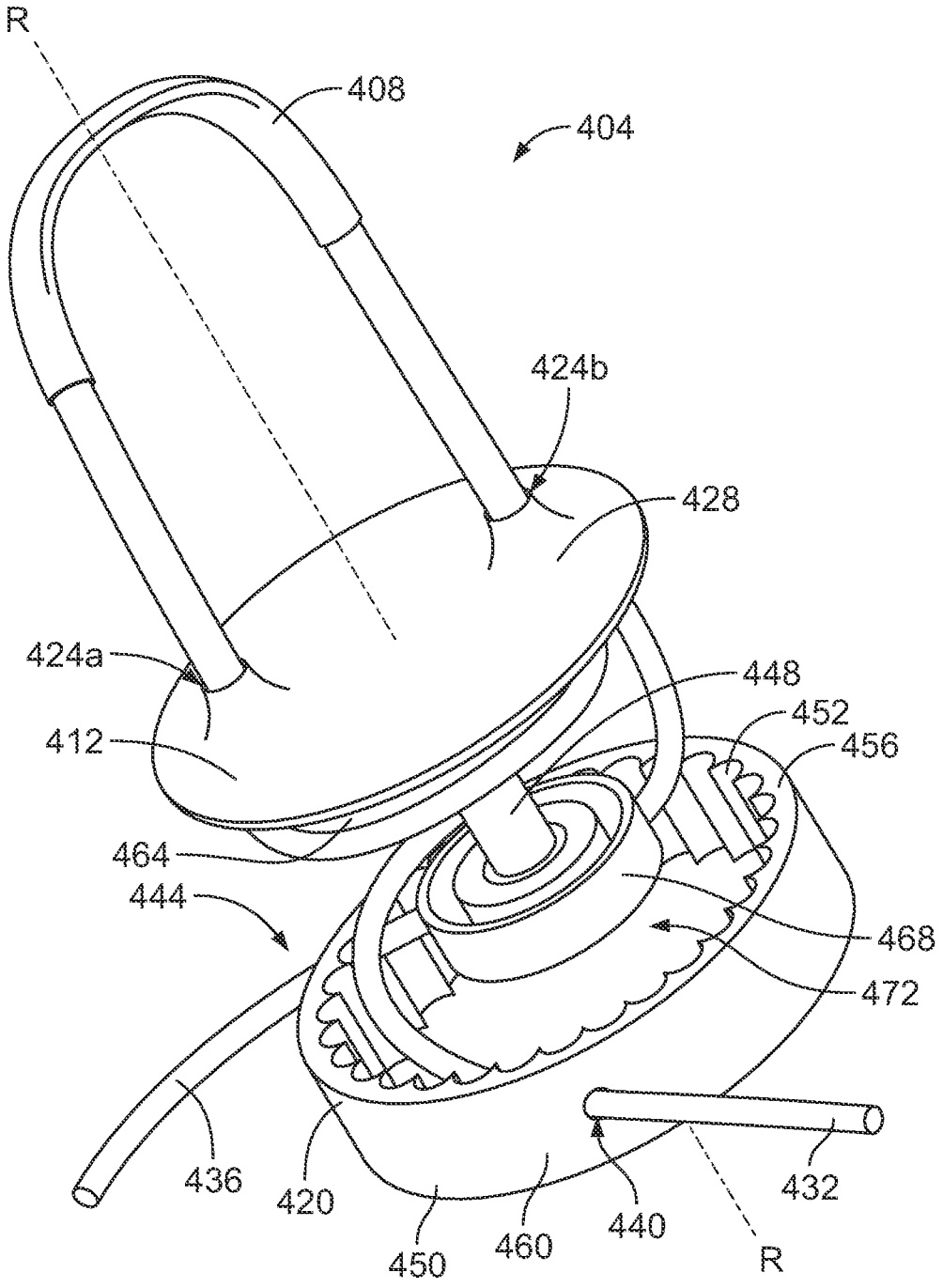
FIG. 9 is a schematic representation of an exploded, partial view of a closure system for the article of footwear of FIG. 8.

FIG. 8 depicts a schematic representation of the lateral side 116 of an article of footwear 400 similar to the footwear 300 and the footwear 200. The footwear 400 has a closure system 404 that includes an actuation mechanism in the form of a strap 408, a release mechanism 412 in the form of a switch or button, and a cord 416. Further, the closure system 404 has a closure mechanism or disc 420 that is connected to the release mechanism 412 and operatively coupled to the cord 416 and the strap 408, as illustrated in FIGS. 8 and 9. In the illustrated embodiment, the strap 408 extends from apertures 424*a*, 424*b* formed in a circular face 428 of the closure system 404 and a rotational axis R extends centrally through the face 428. In particular, the release mechanism 412 and the disc 420 are intersected by and axially aligned with the rotational axis R, although other configurations are possible. In the illustrated embodiment, the cord 416 includes a first segment 432 and a second segment 436 (see FIG. 9) that each extend outwardly from first and second passages 440, 444, respectively, of the disc 420 to tighten the upper 102 and/or sole 104 of the footwear 400. Referring to FIG. 8 again, the closure system 404 is provided as a consolidated unit or package configured to be centralized and mounted on the footwear 400. By contrast, the closure systems 204 and 304 are decentralized in that the actuation mechanism, i.e., the straps 208 and 308, and the closure mechanism, i.e., the discs 220 and 320, are spaced apart from one another on the footwear 200 and 300, respectively. Further, as illustrated in FIG. 8, a ring 446 is disposed about, e.g., circumscribes, the disc 420 and, although not depicted in FIG. 9, the ring 446 conceals the passages 440, 444 through which the first segment 432 and the second segment 436 of the cord 416 extend (see FIG. 9). In some embodiments, the ring 446 is configured to be rotated or twisted about the rotational axis R to release or unlock the closure system 404, in addition to or alternatively to the release mechanism 412.

As illustrated in FIG. 9, the centralized closure system 404 has a shaft 448 to which the release mechanism 412 is attached for rotational movement relative to the disc 420. Further, the disc 420 comprises a housing 450 that has a plurality of teeth 452 arranged radially on an inside surface 456 of a sidewall 460 thereof for rotational engagement with a gear (not shown) provided on a spool 464 of the release mechanism 412. A portion of the cord 416 is wound around the spool 464 of the release mechanism 412. In some embodiments, the first segment 432 of the cord 416 is threaded through the first passage 440 and wound around the spool 464. In other embodiments, the second segment 436 of the cord 416 is threaded through the second passage 444 and wound around the spool 464. In still other embodiments, both the first and second segments 432, 436 are wound around the spool 464. In addition, the disc 420 receives a coil spring 468 concentrically disposed within a chamber 472 of the housing 450 and axially aligned with the rotational axis R. When the closure system 404 is assembled, the coil spring 468 is positioned between the disc 420 and the spool 464 of the release mechanism 412, although other configurations are possible.

In one implementation in which the second segment 436 is wound around the spool 464, the closure system 404 is actuated by a user applying a tensional force, i.e., pulling, the strap 408 away from the release mechanism 412 and against the force of the coil spring 468 to reach an actuated configuration (as illustrated in FIG. 9), which causes the spool 464 of the release mechanism 412 to rotate about the rotational axis R As the spool 464 rotates, the face 428 of the release mechanism 412 and the disc 420 both remain fixed in place and do not rotate about the rotational axis R. Further, as the spool 464 rotates, the second segment 436 of the cord 416 is retrieved through the second passage 444 and wound around the spool 464, which causes the tensional force to be applied to the second segment 436 and conveyed to the footwear 400 as a compression force for tightening the footwear 400. In addition, as the spool 464 is rotated about the rotational axis R within the disc 420, the gear (not shown) engages with the plurality of teeth 452 arranged on the disc 420 to prevent backwards rotation or unwinding and to iteratively secure the spool 464 in its rotational displacement about the rotational axis R. Due to the mechanical interaction between the gear (not shown) and the plurality of teeth 452 of the disc 420, audible sounds resembling "clicks" and perceptible vibrations may be produced for providing acoustic and haptic feedback to a user, such that the user can associate such feedback with operation of the closure system 404.

Subsequently, after the user releases the strap 408, the coil spring 468 retracts the strap 408 back toward the release mechanism 412 into the rest configuration, while the spool 464 remains locked in its radial displacement position by interaction between the gear (not shown) and the plurality of teeth 452 on the disc 420. At this point, when the spool 464 is locked in its radial displacement position and the strap 408 has returned to the rest configuration, the first segment 432 and the second segment 436 are locked or secured against movement and, thus, the closure system 404 has reached a first tightening level of a tightening configuration of the footwear 400. It is contemplated that pulling the strap 408 again will cause farther radial displacement of the spool 464 within the disc 420 to reach a second tightening level of increased compression force, i.e., tighter, than the first tightening level, at which point the spool 464 is locked into place by the interaction of the gear (not shown) and the plurality of teeth 452. In this manner, increased tightening levels may be achieved beyond the second tightening level, as desired by a user. To release or unlock the closure system 404 from the tightened configuration, the user can press down on the face 428 of the release mechanism 412 to move the gear (not shown) out of engagement with the plurality of teeth 452, thereby unlocking the spool 464 from the disc 420 and allowing reverse or backward rotation.

In another implementation, the closure system 404 is released or unlocked by rotating or twisting the ring 446 (see FIG. 8). Referring to FIGS. 8 and 9, the ring 446 can be configured to be rotated to disengage the gear (not shown) of the release mechanism 412 from the plurality of teeth 452 of the disc 420. For example, the ring 446 may be coupled to the release mechanism 412 to cause axial displacement of the release mechanism 412 from the disc 420, such that the gear (not shown) provided on the spool 464 of the release mechanism 412 becomes axially displaced out of engagement with the plurality of teeth 452 of the disc 420. As a result, the first segment 432 and the second segment 436 of the cord 416 are unlocked or loosened and, thus, the footwear 400 is adjusted from the tightened configuration to the loosened configuration by rotation of the ring 446.

Figure 10:
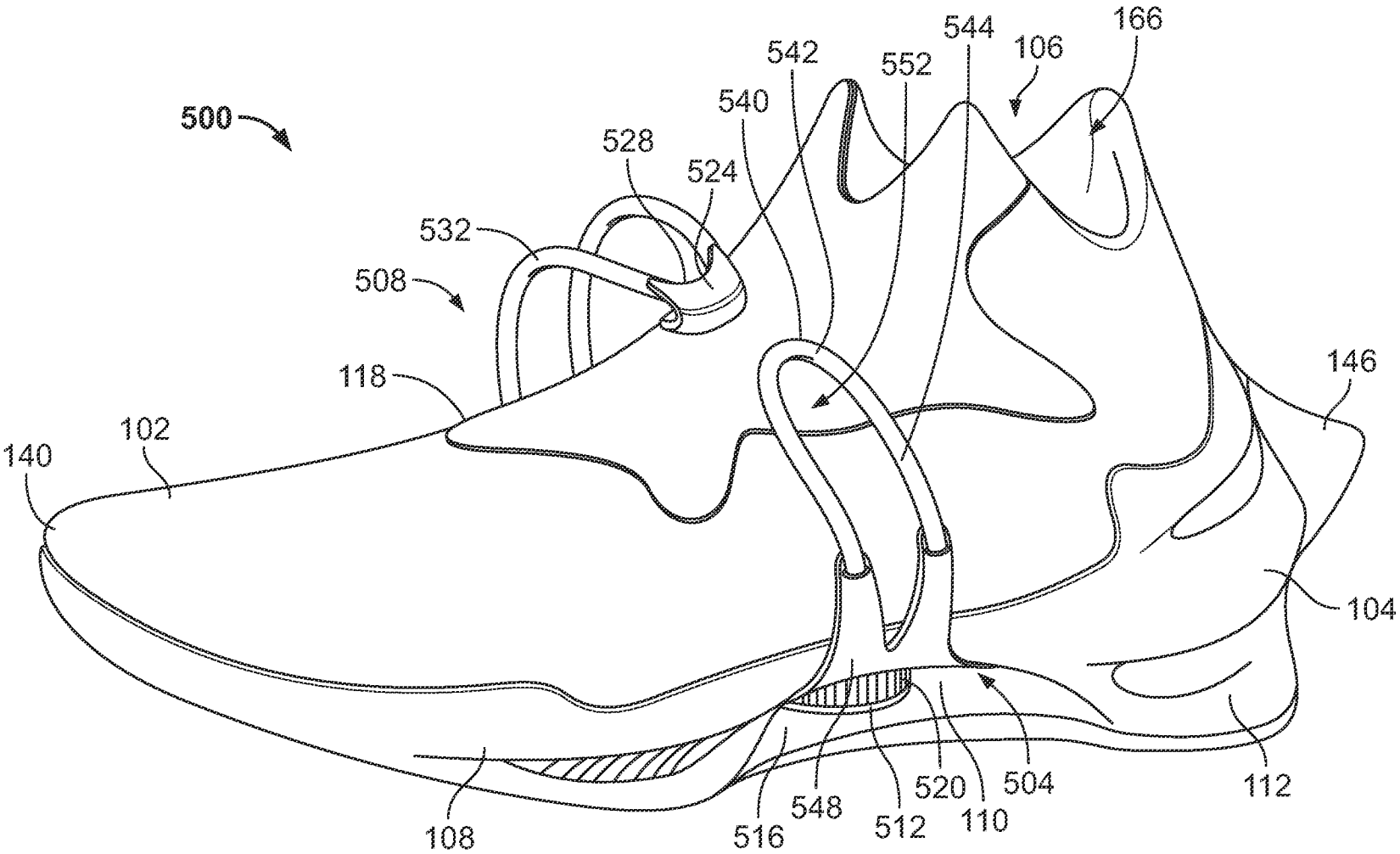
FIG. 10 is a schematic representation of a perspective lateral side and toe end view of still another article of footwear configured as a left shoe, according to an embodiment of the disclosure.

FIG. 10 illustrates another schematic representation of lateral side view of an article of footwear 500 having a closure system 504 that is arranged within the midfoot 110 of the footwear 500. It is contemplated that the closure system 504 is similar to the centralized, packaged closure system 404. In the illustrated embodiment, the closure system 504 has a combined actuation mechanism and release mechanism in the form of a latch assembly 508 extending from the lateral side 116 to the medial side 118 of the sole 104 and around the midfoot region 110 of the upper 102. Further, the closure system 504 has a closure mechanism or disc 512 mounted on the sole 104 within an arch region 516 of the midfoot region 110. The arch region 516 is a region corresponding to the location of the arch of a user's foot within the upper 102 when the footwear 500 is worn. The disc 512 includes external ridges 520 that are exposed and configured to be accessible to a user within the arch region 516. In the illustrated embodiment, the latch assembly 508 includes a hook 524 that is positioned at a first distal end 528 of a first wireframe 532 that extends from a first base (not shown) disposed on the medial side 118 of the footwear 500. As illustrated in FIG. 10, the hook 524 is positioned in the rest configuration and configured to be actuated by articulation toward the lateral side 116 of the footwear 500. In addition, the latch assembly 508 includes a latch 540 at a second distal end 542 on a second wireframe 544 that extends from a second base 548 disposed on the lateral side 116 of the footwear 500. Similar to the hook 524, the latch 540 is illustrated in the rest configuration in FIG. 10 and configured to be articulated toward the medial side 118 of the footwear 500. The second wireframe 544 forms a slot 552 into which the hook 524 is received when the hook 524 is articulated, e.g., by bending or rotating the first wireframe 532 about the first base (not shown), toward the lateral side 116 and the latch 540.

To loosen or unlock the closure system 504, a user may unfasten the hook 524 from the latch 540 by articulating the hook 524 toward the lateral side 116 beyond engagement with the latch 540, which may also be assisted by articulating the latch 540 toward the medial side 118, and then pulling vertically upward, away from the upper 102, until the hook 524 is retracted back toward the medial side 118 by the self-biasing, forces provided by the first wireframe 532 and the first base (not shown) due to bending and/or displacement from the rest configuration. To that end, the first wireframe 532 and the second wireframe 544 are preferably formed of a resilient and flexible material. Further, the closure system 504 can be tightened or loosened by manipulation, e.g., rotation, of the disc 512 to translate the first base (not shown) and the second base 548 toward each other. Alternatively, operation of the disc 512 may retrieve portions of the first wireframe 532 and/or the second wireframe 544, such that, the latch assembly 508 becomes increasingly restricted around the upper 102 and, thus, the user's foot when the footwear 500 is worn. In some embodiments, the disc 512 can be rotated counterclockwise to tighten the footwear 500 and clockwise to unlock or release the footwear 500 from the tightened configuration, thereby allowing the user to loosen the footwear 500.

Figure 11:
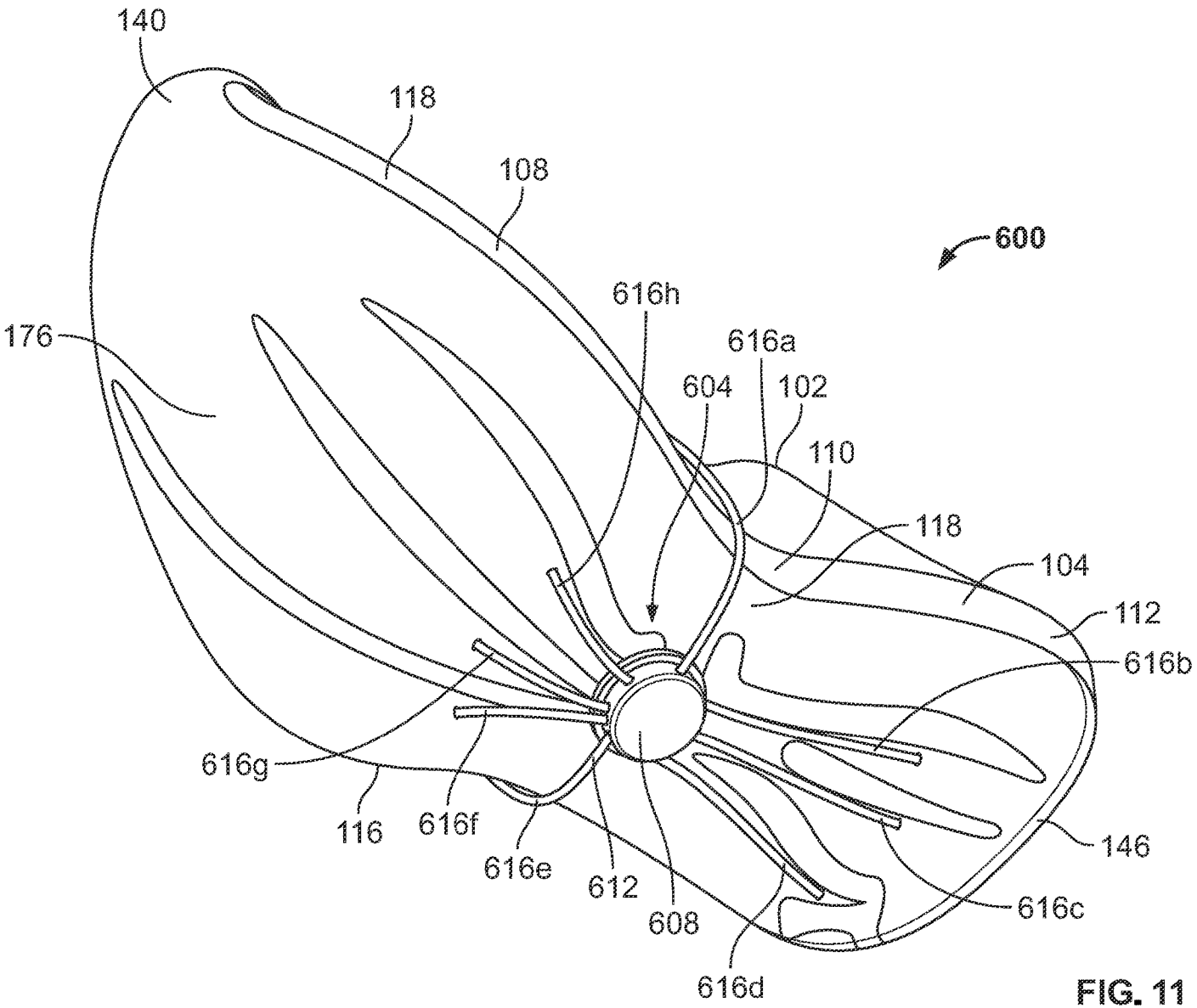
FIG. 11 is a schematic representation of a perspective bottom and medial side view of yet another article of footwear configured as a right shoe, according to an embodiment of the disclosure.

Referring to FIG. 11, which depicts a schematic representation of an article of footwear 600, a closure system 604 is arranged on the sole 104 within the midfoot region 110 of the footwear 600. In the illustrated embodiment, the closure system 604 includes a closure mechanism or 608 mounted to the bottom surface 176 of the sole 104 and operably engaged with a cord 612 for tightening and loosening the footwear 600. It is contemplated that the closure system 604 can incorporate any of the actuation mechanisms and release mechanisms described in connection with the closure systems 204, 304, 404, 504. As illustrated in FIG. 11, the cord 612 is operably engaged with the disc 608 and includes multiple segments 616*a-h* extending across the sole 104 and the upper 102 in a web-like winding pattern. By locating the disc 608 on the sole 104 and within the midfoot region 110 of the footwear 600, the mass of the disc 608 is centralized on the footwear 600 to provide a balanced distribution of mass or center of gravity of the footwear 600, which may be desirable for applications involving high performance characteristics. In addition, the disc 608 is at least partially concealed underneath the footwear 600 so as to be inconspicuous, which may be desirable for aesthetic purposes.

Figure 12:
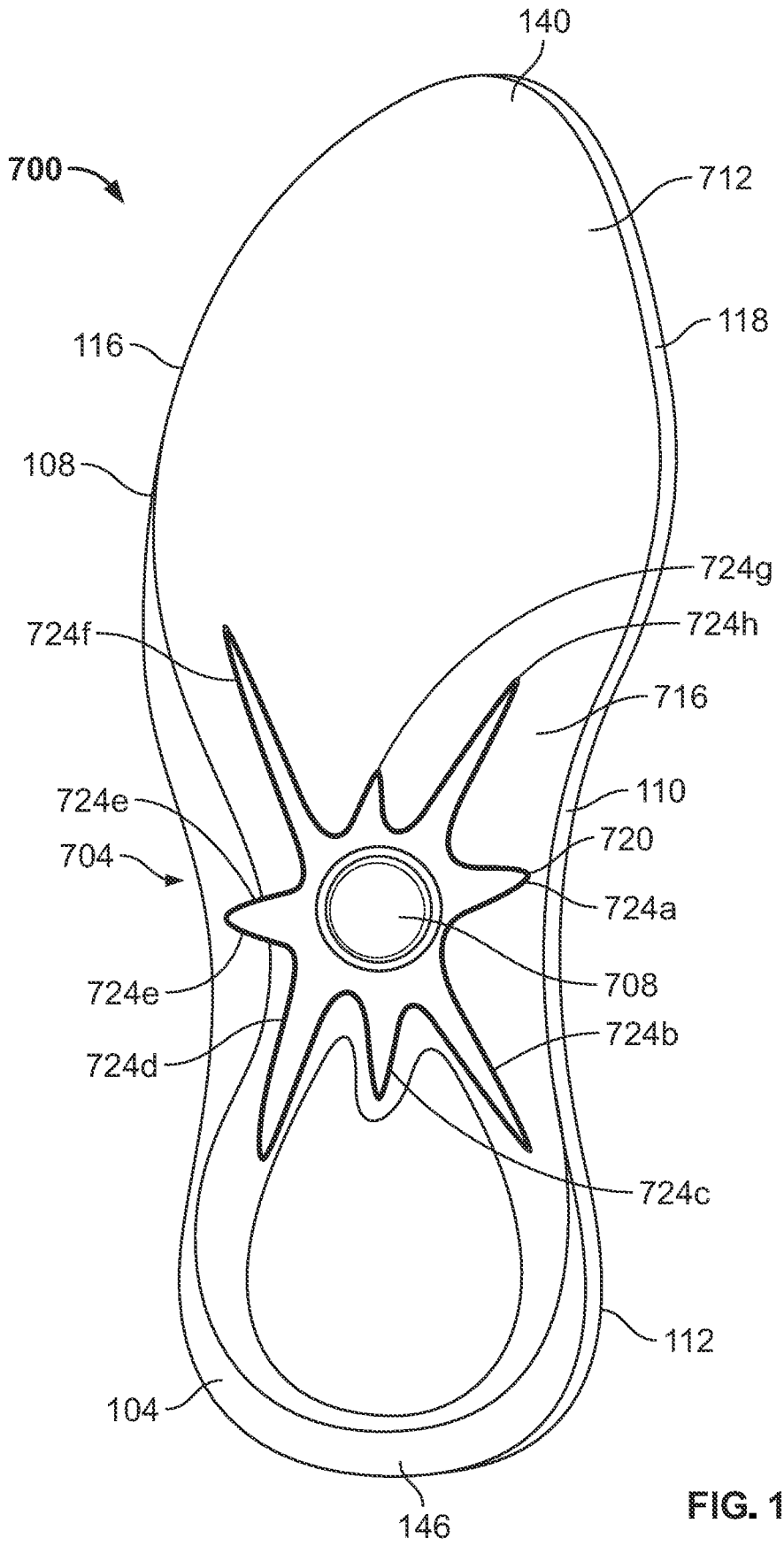
FIG. 12 is a schematic representation of a top plan view of still another article of footwear configured as a left shoe, with an upper removed, according to an embodiment of the disclosure.

FIG. 12 illustrates a schematic representation of a top plan view of a sole 104 of an article of footwear 700 having a closure system 704. In the illustrated embodiment, the closure system 704 includes a closure mechanism or disc 708 mounted on the sole 104 in the midfoot region 110. In particular, the disc 708 is at least partially embedded in a top surface 712 of the sole 104 and centrally disposed between the lateral side 116 and the medial side 118 of the footwear 700. Further, the disc 708 is located within an arch 716 of the sole 104, which is a region corresponding to a location of the arch of a user's foot within the upper 102 when the footwear 700 is worn. It is contemplated that the closure system 704 can incorporate any of the actuation mechanisms and release mechanisms described in connection with the closure systems 204, 304, 404, 504. As illustrated in FIG. 12, a cord 720 is operably engaged with the disc 708 and includes multiple segments 724*a-h* extending across the sole 104 in a web-like winding pattern.

In some embodiments, the footwear 700 may include the insole 126 (see FIG. 2) to cover the disc 708, such that the disc 708 is encapsulated between the insole 126 and other portions of the sole 104 and accessible by removal or displacement of the insole 126. In some embodiments, an access plug (not shown) may be provided on the sole 104 of the footwear 700 for accessing the disc 708. Further, the disc 708 may be entirely enclosed and inaccessible without permanent deformation of the footwear 700. Whether the disc 708 is accessible or inaccessible, encapsulating the disc 708 provides protection from damage due to impact with external surfaces or objects during use, from outdoor environments, or even damage due to manipulation or impact applied by the user. By locating the disc 708 within the sole 104 and within the midfoot region 110 of the footwear 700, the mass of the disc 708 is centralized on the footwear 600 to provide a balanced distribution of mass or center of gravity of the footwear 700, which may be desirable for applications involving high performance characteristics. In addition, the disc 708 is concealed so as to be inconspicuous, which may be desirable for aesthetic purposes. It is contemplated that the closure system 704 can be embedded within the sole 104, so as to be encapsulated entirely within the sole 104, or, it could be at least partially encapsulated or embedded within the sole 104 for protection from outdoor environments, collisions due to use, and the like.

It is also contemplated that any of the closure systems 204, 304, 404, 504, 604, 704 described herein may incorporate a closure mechanism similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein. For example, it is contemplated that the disc 220, 320, 420, 512, 608, 708 may include one or more aspects of such closure mechanisms to provide tightening or loosening functionality when mounted on the respective footwear 200, 300, 400, 500, 600, 700 of the present disclosure.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A closure system for an article of footwear, comprising:
an actuation mechanism;
a release mechanism;
a closure mechanism; and
a cord that is configured to be operably engaged with an upper of the footwear, wherein the actuation mechanism is configured to be pulled to actuate the closure system to adjust the footwear from a loosened configuration to a tightened configuration, wherein the release mechanism is configured to adjust the footwear from the tightened configuration to the loosened configuration, and wherein the release mechanism is located in a top section of the upper and the actuation mechanism extends from the upper at a location that is spaced apart from the release mechanism,
wherein the cord includes a first segment that has a first end that terminates at the actuation mechanism and has a second end that terminates at the release mechanism,
wherein the first segment includes a first lowermost point positioned between the first end and the second end of the first segment, and
wherein the first lowermost point is configured to change position when a force is applied to the first segment.

2. The closure system of claim 1, wherein the actuation mechanism includes a strap.

3. The closure system of claim 1, wherein the release mechanism includes a dial.

4. The closure system of claim 1, wherein the closure mechanism includes a disc.

5. The closure system of claim 1, wherein the closure mechanism is configured to hold the footwear in the tightened configuration.

6. The closure system of claim 1, wherein the cord is comprised of multiple segments operably coupled to one another by the closure mechanism.

7. The closure system of claim 1, wherein a retention member is disposed on the upper to retain a portion of the cord.

8. The closure system of claim 1, wherein the tightened configuration comprises varying levels of tightness which include a first level, a second level, and a third level, wherein the third level is tighter than the second level, and wherein the second level is tighter than the first level.

9. A closure system for an article of footwear having a sole connected to an upper, comprising:
an actuation mechanism;
a release mechanism having a circular face; and
a closure mechanism, wherein the closure system is decentralized, wherein the closure system is operably connected by a cord that extends along the footwear, wherein the actuation mechanism includes a strap that extends from the upper at a location that is spaced apart from the release mechanism,
wherein the cord includes a first segment that has a first end that terminates at a first end of the strap and has a second end that terminates at the release mechanism,
wherein the first segment includes a first lowermost point positioned between the first end and the second end of the first segment, and
wherein the first lowermost point is configured to change position when a force is applied to the first segment.

10. The closure system of claim 9, wherein the actuation mechanism is arranged in a heel region of the footwear and the release mechanism is arranged in a midfoot region of the footwear.

11. The closure system of claim 9, wherein the closure mechanism is positioned on the upper within a midfoot region of the footwear.

12. The closure system of claim 9, wherein the closure mechanism is disposed within the sole of the footwear.

13. The closure system of claim 9, wherein the closure mechanism and the release mechanism are arranged in a midfoot region of the footwear.

14. The closure system of claim 9, wherein the cord includes the first segment and a second segment, the first segment extending between the actuation mechanism and the closure mechanism and the second segment extending from the closure mechanism to a retention member.

15. The closure system of claim 14, wherein the first segment of the cord is formed of an elastic material that is configured to retract the actuation mechanism from an actuation configuration to a rest configuration.

16. An article of footwear, comprising:
an upper that is attached to a sole;
a longitudinal axis that extends between a rear end and a front end of the article of footwear;
a midfoot region that is disposed between a forefoot region and a heel region;
a heel component disposed adjacent the rear end within the heel region, the heel component having a midsection that includes padding; and
a fastening system including a release mechanism that is operably engaged with a cord, wherein the release mechanism defines a circular top profile and is mounted to a top section of the upper within the midfoot region, wherein the cord is laced through a plurality of conduits arranged on the upper, wherein a distance is defined between the midsection of the heel component and the upper, wherein the distance is configured to be adjusted between a first configuration and a second configuration, wherein the midsection of the heel component is configured to be translated rearward and upward relative to the longitudinal axis, and wherein the midsection of the heel component is configured to be translated forward and downward relative to the longitudinal axis, wherein the upper defines an edge that partially surrounds a tongue and wherein the plurality of conduits arranged on the upper are spaced outwardly from the edge relative to the longitudinal axis, and wherein the cord is routed through the conduits formed in the forefoot region.

17. The article of footwear of claim 16, wherein the midsection of the heel component is configured to be gripped by a user.

18. The article of footwear of claim 17, wherein the midsection of the heel component extends between a first end and a second end of the heel component, the first end being arranged adjacent a medial side of the article of footwear and the second end being arranged adjacent a lateral side of the article of footwear.

19. The article of footwear of claim 18, wherein the midsection of the heel component is concavely curved between the medial side and the lateral side of the article of footwear relative to a toe end of the article of footwear.

20. The article of footwear of claim 19, wherein the midsection of the heel component is configured to at least partially deform when translated between the first configuration and the second configuration.

21. The article of footwear of claim 20, wherein at least a portion of the cord is arranged on the upper between the medial side and the lateral side of the article of footwear to form a V-shaped pattern.

22. The article of footwear of claim 21, wherein the release mechanism is disposed centrally between the lateral side and the medial side of the article of footwear.

* * * * *